US011697952B2

(12) United States Patent
Ottino

(10) Patent No.: US 11,697,952 B2
(45) Date of Patent: Jul. 11, 2023

(54) POWER ACTUATION MECHANISM FOR OPERATION OF CLOSURE PANEL OF A VEHICLE

(71) Applicant: Magna Closures Inc., Newmarket (CA)

(72) Inventor: Franco Giovanni Ottino, San Giuliano Terme (IT)

(73) Assignee: Magna Closures Inc., Newmarket (CA)

( * ) Notice: Subject to any disclaimer, the term of this patent is extended or adjusted under 35 U.S.C. 154(b) by 696 days.

(21) Appl. No.: 16/667,006

(22) Filed: Oct. 29, 2019

(65) Prior Publication Data

US 2020/0131836 A1 Apr. 30, 2020

Related U.S. Application Data

(60) Provisional application No. 62/751,923, filed on Oct. 29, 2018.

(51) Int. Cl.

| | |
|---|---|
| ***E05F 15/00*** | (2015.01) |
| ***E05B 81/14*** | (2014.01) |
| ***E05B 81/20*** | (2014.01) |
| ***E05F 15/616*** | (2015.01) |

(52) U.S. Cl.
CPC ..... *E05B 81/14* (2013.01); *E05B 81/20* (2013.01); *E05F 15/616* (2015.01)

(58) Field of Classification Search
CPC ..... E05F 15/616
See application file for complete search history.

(56) References Cited

U.S. PATENT DOCUMENTS 3,154,302 A * 10/1964 Kunimori ..... E05F 15/616 74/415
4,121,382 A 10/1978 Dietrich et al.
4,395,064 A * 7/1983 Bellot ..... E05B 81/20 292/201

(Continued)

FOREIGN PATENT DOCUMENTS

CN 1175989 A 3/1998
CN 105089383 B 11/2015

(Continued)

OTHER PUBLICATIONS

English translation of DE19828040 (Year: 1999).*
English translation of WO2015139678 (Year: 2015).*
English translation of FR2518621 (Year: 1983).*

*Primary Examiner* — Janet M Wilkens
*Assistant Examiner* — Daniel Alvarez

(57) ABSTRACT

A powered actuation mechanism for operating a closure panel device coupled to a closure panel of a vehicle, the closure panel operated between a closed position and a partially open position, the mechanism including: a motor operatively coupled to a control member; a lever body mounted at a pivot end to a body of the vehicle by a first pivot connection and coupled at an output end to a closure panel device by a second pivot connection, the lever body for driving the closure panel device; the control member having a control connection coupling the control member to the lever body, the control connection moveable between the first pivot connection and the second pivot connection such that the lever body has an opening to provide a releasable engagement of the control connection between the lever body and the control member.

18 Claims, 19 Drawing Sheets

(56) References Cited

U.S. PATENT DOCUMENTS

| | | | | |
|---|---|---|---|---|
| 6,213,524 | B1 | 4/2001 | Bree et al. | |
| 6,848,727 | B1 | 2/2005 | Cetnar et al. | |
| 6,948,745 | B2 | 9/2005 | Chevalier | |
| 7,261,334 | B2 | 8/2007 | Oberheide et al. | |
| 7,575,270 | B2 | 8/2009 | Nagai et al. | |
| 8,474,888 | B2 | 7/2013 | Tomaszewski | |
| 9,995,066 | B1 | 6/2018 | Ottolini et al. | |
| 11,199,031 | B2 | 12/2021 | Wirths | |
| 2004/0055407 | A1* | 3/2004 | Coleman | H02K 7/10 74/425 |
| 2004/0174021 | A1* | 9/2004 | Tensing | E05B 81/66 292/216 |
| 2004/0244294 | A1 | 12/2004 | Schachtl | |
| 2010/0235058 | A1 | 9/2010 | Papanikolaou et al. | |
| 2017/0284134 | A1 | 10/2017 | Schwickerath et al. | |
| 2019/0003214 | A1 | 1/2019 | Cumbo et al. | |
| 2019/0153768 | A1 | 5/2019 | Termine et al. | |
| 2020/0263459 | A1 | 8/2020 | Debroucke et al. | |
| 2020/0284068 | A1 | 9/2020 | Cumbo et al. | |

FOREIGN PATENT DOCUMENTS

| | | | | |
|---|---|---|---|---|
| CN | 205743493 | U | 11/2016 | |
| DE | 19828040 | A1 * | 12/1999 | E05B 81/14 |
| DE | 102011015669 | A1 | 10/2012 | |
| FR | 2518621 | A1 * | 6/1983 | E05B 81/14 |
| JP | 2005220664 | A | 8/2005 | |
| WO | WO-2015139678 | A1 * | 9/2015 | E05B 81/20 |

* cited by examiner

POWER ACTUATION MECHANISM FOR OPERATION OF CLOSURE PANEL OF A VEHICLE

CROSS-REFERENCE TO RELATED APPLICATION

This application claims priority from the benefit of the filing date of U.S. Provisional Patent Application No. 62/751,923 filed on Oct. 29, 2018, entitled "POWER ACTUATION MECHANISM FOR OPERATION OF CLOSURE PANEL OF A VEHICLE", the contents of which are herein incorporated by reference.

FIELD

This disclosure relates to power actuation mechanisms and in particular a presentment mechanism for a closure panel.

BACKGROUND

Current door latching systems which do not employ physical handles to activate opening of the door need some kind of door presenter to provide for door opening after latch release has occurred. Presentment of the door facilitates the vehicle user to grab the door and move it to the fully open door position. Presentment of the door also may facilitate overcoming door seal loads, as well as provide ice breaking functionality to overcome ice buildup tending to bind the door to the vehicle body. Current door designs can provide for a complex presentment actuators to achieve the required presentment operation, which is disadvantageous due to extra materials and cost associated with multiple actuation mechanisms. Further, current presentment mechanisms may interfere with manual operation of the vehicle door by an occupant of the vehicle once presentment has occurred.

SUMMARY

It is an object of the present invention to provide an actuation mechanism for a vehicle door to obviate or mitigate at least one of the above presented disadvantages.

A first aspect provided is a powered actuation mechanism for operating a closure panel device coupled to a closure panel of a vehicle, the closure panel operated between a closed position and a partially open position, the mechanism including: a motor operatively coupled to a control member; a lever body mounted at a pivot end to a body of the vehicle by a first pivot connection and coupled at an output end to a closure panel device by a second pivot connection, the lever body for driving the closure panel device; the control member having a control connection coupling the control member to the lever body, the control connection moveable between the first pivot connection and the second pivot connection such that the lever body has an opening to provide a releasable engagement of the control connection between the lever body and the control member; wherein operation of the motor causes movement of the control member in order to displace the control connection along the lever body between the opening and the output end such that the control connection is engaged between the lever body and the control member when the control connection is positioned between the opening and the output end and the control connection is disengaged when the control connection is positioned at the opening by the movement of the control member, such that the closure panel device can be operated independently of the control member during said disengaged.

A second aspect provided is a method for operating a powered actuation mechanism coupled to a closure panel device connected to a closure panel of a vehicle, the closure panel operated between a closed position and a partially open position, the method including: operating a motor during a first stage of actuation, the motor operatively coupled to a control member in order to move the control member in order to displace a control connection engaged between the control member and a lever body along the lever body between an opening and an output end of the lever body in order to drive the closure panel device coupled to the output end, such that the control connection is engaged between the lever body and the control member when the control connection is positioned between the opening and the output end; operating the motor for moving the control member to disengage the control connection between the control member and the lever body by providing for exit of the control connection from the opening in the lever body, and operating the motor during a second stage of actuation in order to reengage the control connection between the control member and the lever body, such that the closure panel device can be operated independently of the control member during said disengage.

A third aspect provided is a powered actuation mechanism for operating a closure panel device coupled to one of a closure panel and a vehicle body of a vehicle, the closure panel operated between a closed position and a partially open position, the mechanism including: a motor operatively coupled to a control member; and a lever body comprising an input end and an output end, the output end coupled to the closure panel device for driving the closure panel device in response to driving of the input end by the control member, the input end coupled to either the closure panel or the vehicle body; wherein operation of the motor causes movement of the control member over a first range of motion in order to couple with the input end for driving the closure panel device in a first direction, and over a second range of motion in order to couple with the input end for driving the closure panel device in a second direction opposite the first direction.

A fourth aspect provided is a method for operating a powered actuation mechanism coupled to a closure panel device connected to one of a closure panel and a vehicle body of a vehicle, the closure panel operated between a closed position and a partially open position, the method including: operating a motor during a first stage of actuation, the motor operatively coupled to a control member having a control connection engaged with a pivotal lever body coupled to the closure panel device, in order to move the control connection to pivotally drive the lever body to drive the closure panel device in a first direction; and operating the motor during a second stage of actuation in order to move the control connection to pivotally drive the lever body to drive the closure panel device in a second direction opposite the first direction.

BRIEF DESCRIPTION OF THE FIGURES

The foregoing and other aspects will now be described by way of example only with reference to the attached drawings, in which.

DESCRIPTION

Figure 1:
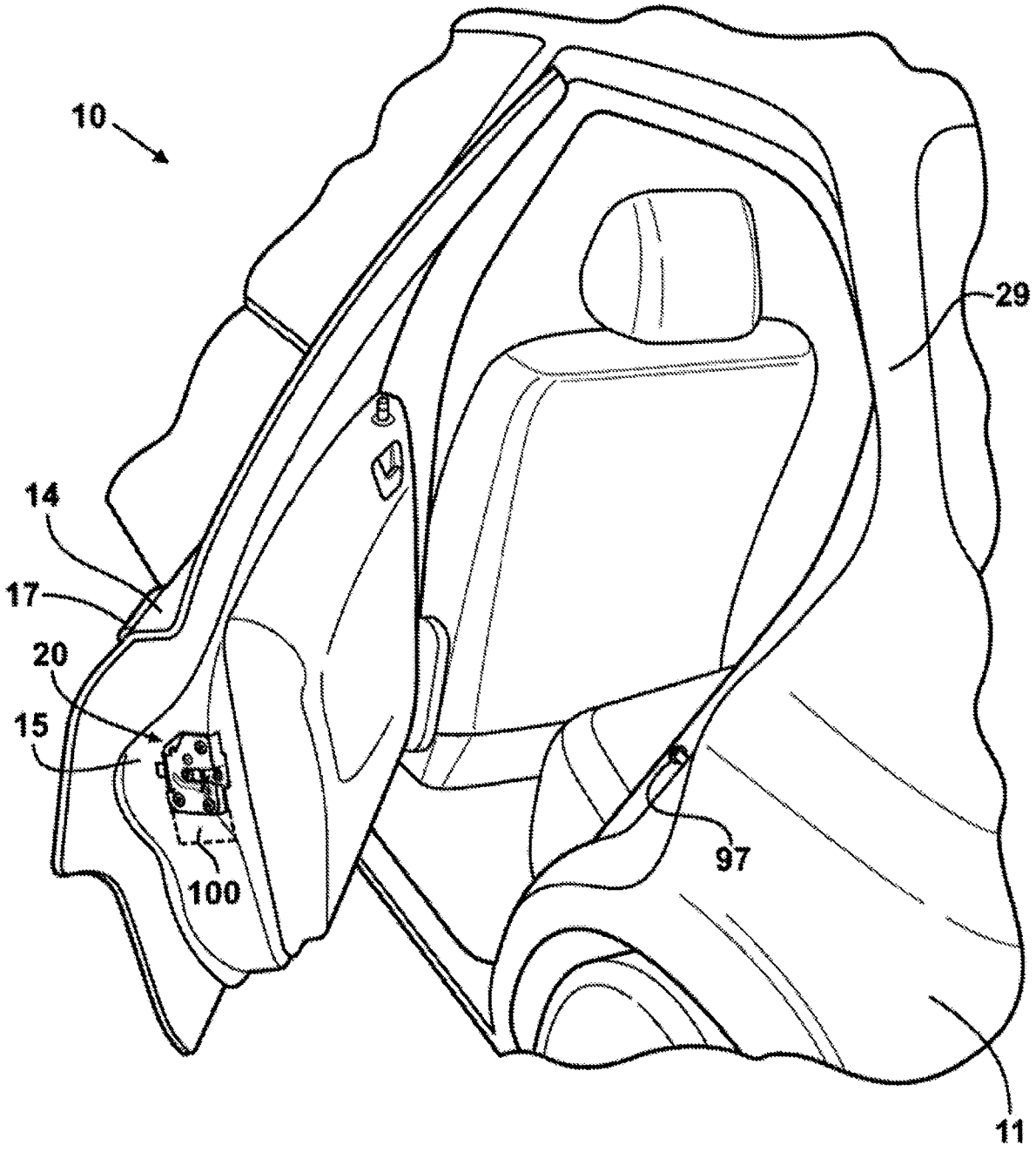
FIG. 1 shows a perspective view of a vehicle closure panel with associated latch.

FIG. 1 is a perspective view of a vehicle 10 that includes a vehicle body 11 and at least one vehicle door 14 (also referred to as closure panel 14). The vehicle door 14 includes a latch assembly 20 that is positioned on an edge face 15 and which is releasably engageable with a striker 97 on the vehicle body 11 to releasably hold the vehicle door 14 in a closed position. An outside door handle 17 and an inside door handle 16 can be optionally provided for opening the latch assembly 20 (i.e. for releasing the latch assembly 20 from the striker 97) to open the vehicle door 14. An optional lock knob 18 is shown and provides a visual indication of the lock state of the latch assembly 20 and may be operable to change the lock state between an unlocked position and a locked position. The closure panel 14 can be positioned adjacent to pillar 29 (of the body 11 of the vehicle 10) when closed, such that a hand of the vehicle user (e.g. driver) is inhibited from insertion between the pillar 29 and the closure panel 14. It is recognized that the latch assembly 20 can be configured as any type of latch (e.g. manual release, power release, with or without cinch functionality, etc.). Latch assembly may 20 may include a fishmouth 101 for facilitating receipt of the striker 97 by the ratchet 21. The closure panel 14 (e.g. occupant ingress or egress controlling panels such as but not limited to vehicle doors and lift gates/hatches) is connected to the vehicle body 11 via one or more hinges (not shown) and the latch assembly 20 (e.g. for retaining the closure panel 14 in a closed position once closed). The latch assembly 20 can be coupled with a powered actuation mechanism 100, as further described below.

Figure 2:
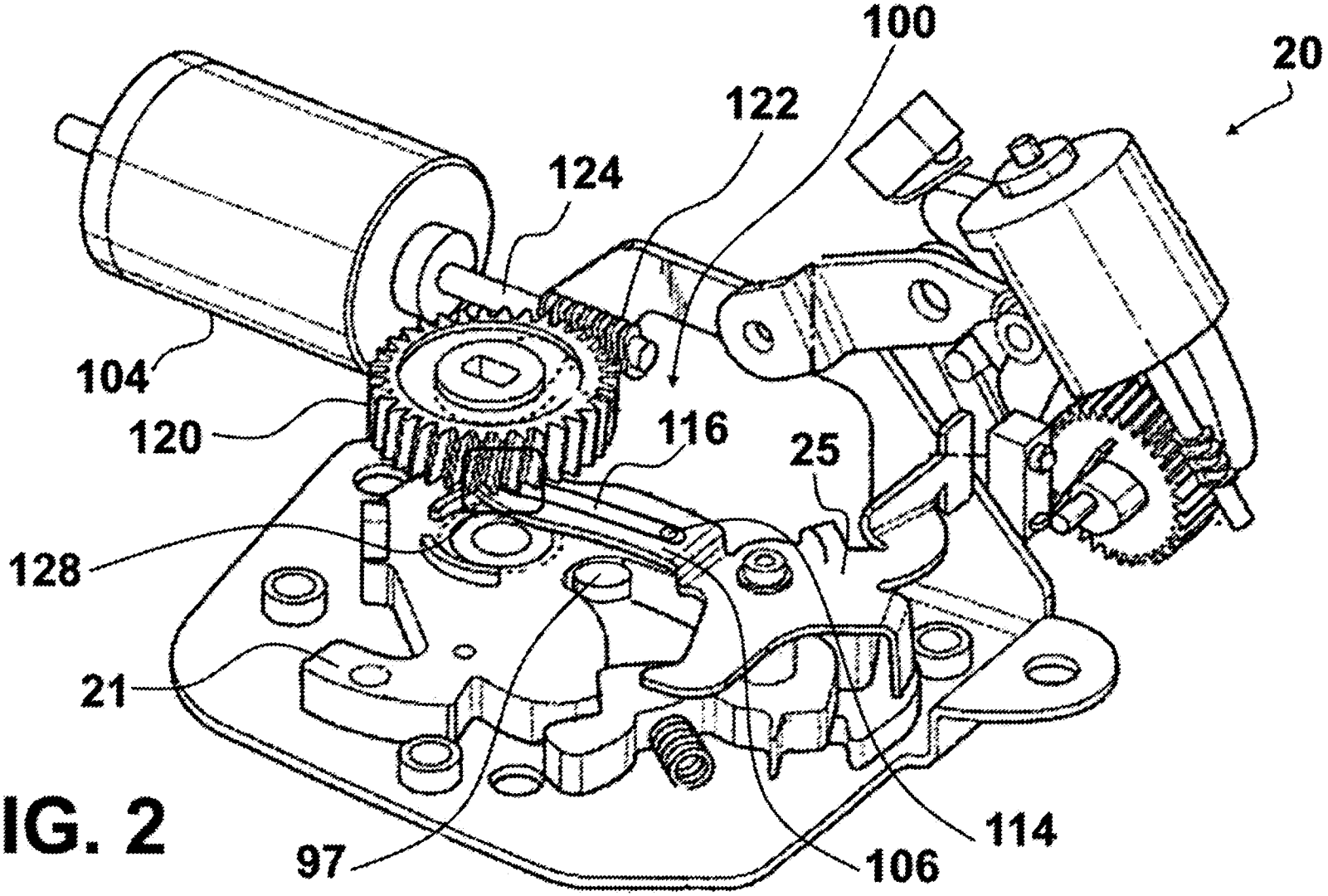
FIG. 2 shows an example latch assembly of FIG. 1 having embodiments of a closure panel device associated with a powered actuation mechanism of FIG. 1.
Figure 13:
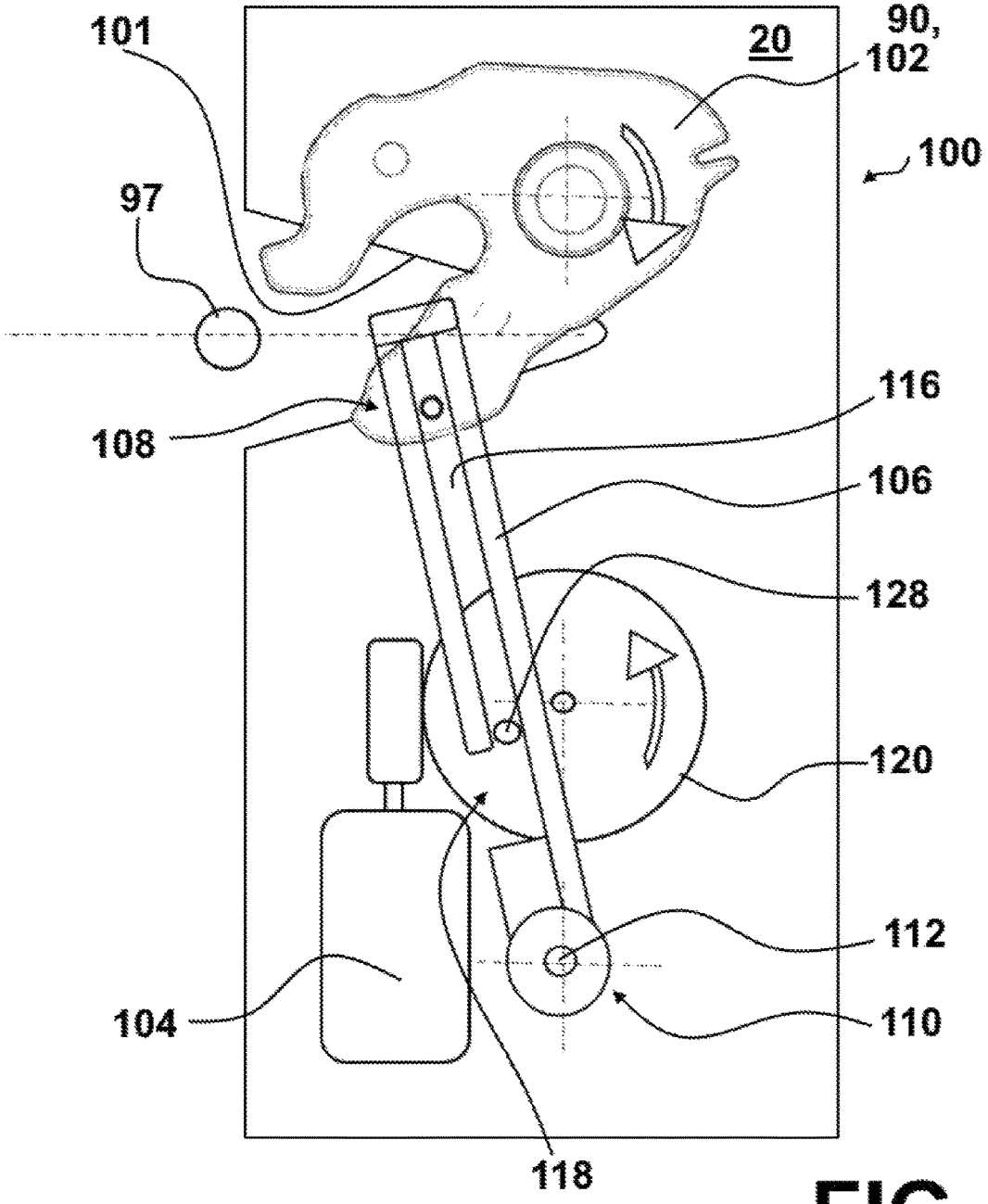
FIG. 13 shows further operation of the powered actuation mechanism of FIG. 12 when reaching the partially open position.

Referring to FIG. 2, shown is a non-limiting embodiment of the latch assembly 20 for the closure panel 14 of the vehicle 10. Latch assembly 20 can be positioned on the closure panel 14 (e.g. by mounting a latch structural back plate 19 to the closure panel 14) and arranged in a suitable orientation to engage a primary first striker, referred to hereafter as striker 97, mounted on vehicle body 11, when the closure panel 14 is closed. Latch assembly 20 can include a latch mechanism having a ratchet 21 and a pawl 23, a latch release mechanism having a pawl release lever 25, and a motor 104 for controlling powered actuation of the latch release mechanism and/or actuation of the ratchet 21 (see FIG. 11 for example). These and other components being mounted to the latch structural back plate 19. Ratchet 21 is movable between two striker capture positions including primary or fully closed position (not shown) wherein ratchet 21 retains striker 97, a secondary or partially closed position (not shown) and an open position (see FIG. 1). The partially open position can be provided such that the ratchet 21 permits release of striker 97 from a slot 95 (see FIGS. 11 and 13) of the latch assembly 20. The powered actuation mechanism includes a lever body 106 with a control connection 128 between a control member 120 and the lever body 106, as further described below.

Figure 3:
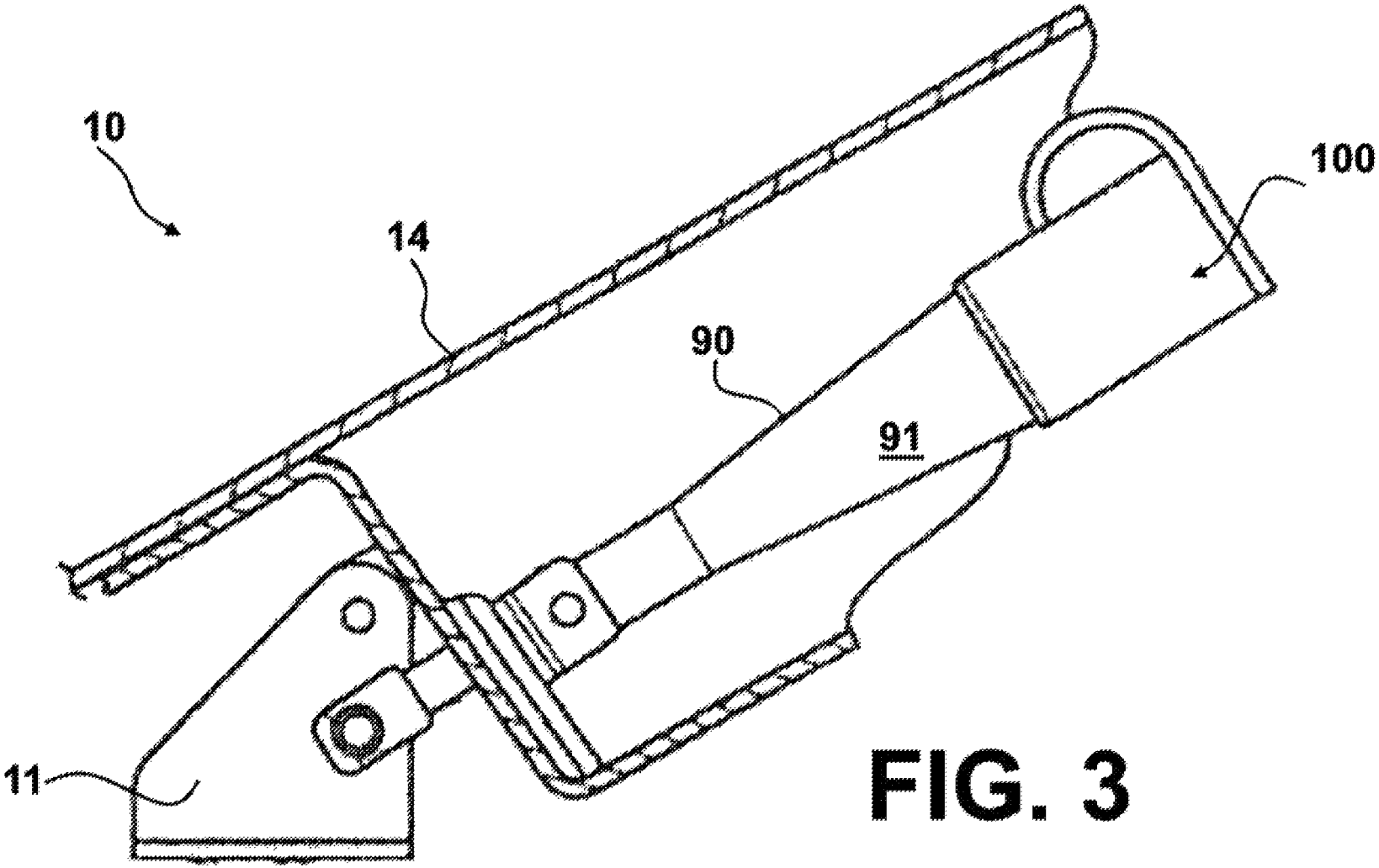
FIG. 3 shows an example door presenter embodiment associated with the powered actuation mechanism of FIG. 1.

Referring to FIG. 3, shown is a door presenter 90 mounted in the closure panel 14 for use in presenting the closure panel 14 from a closed position to a partially open position as shown. The door presenter 90 is coupled to the powered actuation mechanism 100 within housing 91.

Figure 4:
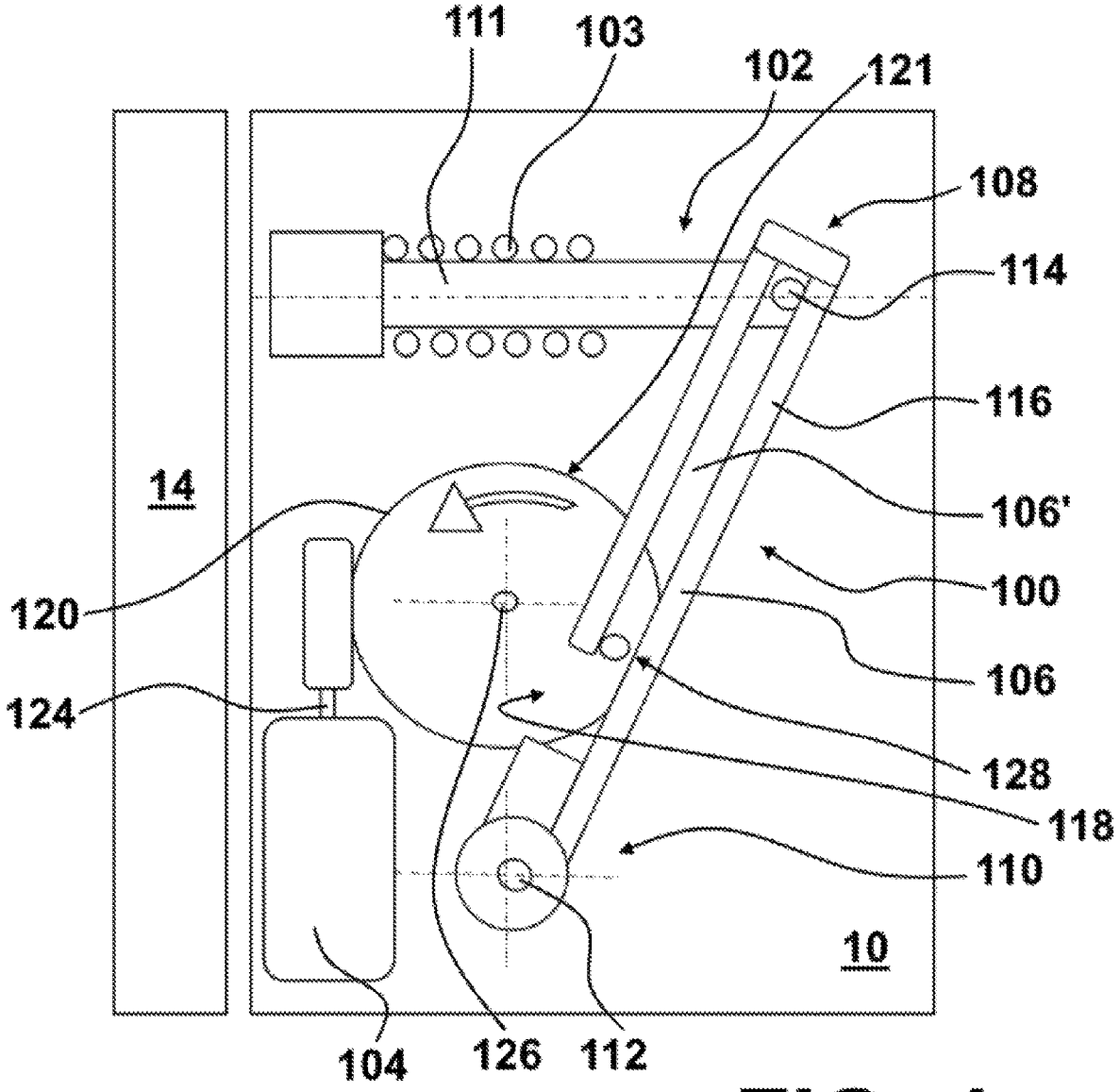
FIG. 4 shows further details of an embodiment of the closure panel device of FIG. 3.

Referring to FIG. 4, shown is the powered actuation mechanism 100 for actuating a closure panel device (generically referred to by reference number 102) coupled to operation of the closure panel 14 (see FIGS. 1-3). Examples of the closure panel device 102 can be the door presenter 90 (see FIG. 3), the ratchet 92 of the latch 94 (see FIGS. 1 and 2) or the release lever 96 (see FIG. 2), shown by example in the environmental views.

Referring again to FIG. 4, the powered actuation mechanism 100 has the motor 104 mounted on the body 11 of the vehicle 10 (see FIG. 1). The lever body 106 is coupled at one end 108 (e.g. output end) to the closure panel device 102 and to a pivot end 110 (also referred to generically as input end 110) on the body 11. It is recognized that the pivot end 110 can also be mounted on the closure panel 14 instead of the body 11, as desired. The coupling at the pivot end 110 is by a first pivot connection 112 (e.g. via a pin mounted on the body 11) and at the output end 108 by a second pivot connection 114 (e.g. via a pin mounted on a body 111 of the closure panel device 102). The pins can also be referred to by their respective pivot connection designations, i.e. pin 112 and pin 114 for the sake of simplicity). The closure panel device 102 can be biased towards an open position by a resilient element 103 (e.g. spring).

The lever body 106 includes a slot 116 extending along the lever body 106 from the output end 108 towards the pivot end 110, such that the pin 114 is retained in the slot 116 during actuation of the closure panel device 102. The slot 116 of the lever body 106 also may include an opening 118 positioned adjacent to the slot 116, the opening 118 opposite to the output end 108, such that the opening 118 is positioned between the output end 108 and the pivot end 112 of the lever body 106. Slot 116 provided with opening 118 is an open slot to allow disengagement of the pin 114 from the slot 116. Slot 116 provided without opening 118 is a closed slot to prevent disengagement of the pin 114 from the slot 116, as illustratively shown in FIG. 4, but applicable to other embodiments of the lever body 106. The motor 104 is coupled to the lever body 106 via a control member 120 (e.g. a disk having gear teeth 121) for engaging with a gear 122 connected to the motor 104 by a shaft 124, which is rotated by the motor 104 in order to drive the control member 120 via the gear 122, for example. For example, the control member 120 can be mounted on an axis 126 coupled/connected to the body 11. The control member 120 is coupled to the lever body 106 by a control connection 128 (e.g. via a pin mounted on the control member 120 and positioned in the slot 116). The pin can also be referred to by its respective connection designation, i.e. pin 128 for the sake of simplicity). Further, the control member 120 can be decoupled from the lever body 106 by providing for the pin 128 to exit the slot 116 via the opening 118.

Accordingly, the pin 128 is retained in the slot 116 during a first stage of actuation (e.g. a first range of motion) of the closure panel device 102 and is decoupled from the slot 116 during a second stage of actuation (e.g. a first range of motion) of the closure panel device 102. This decoupling of the pin 128 from the slot 116 is provided by the pin 128 exiting the slot 116 via the opening 118, as further described below. The control connection 128 between the lever body 106 and the control member 120 can be thus, in one embodiment, engaged during the first stage of actuation and disengaged during the second stage of actuation.

Figure 5:
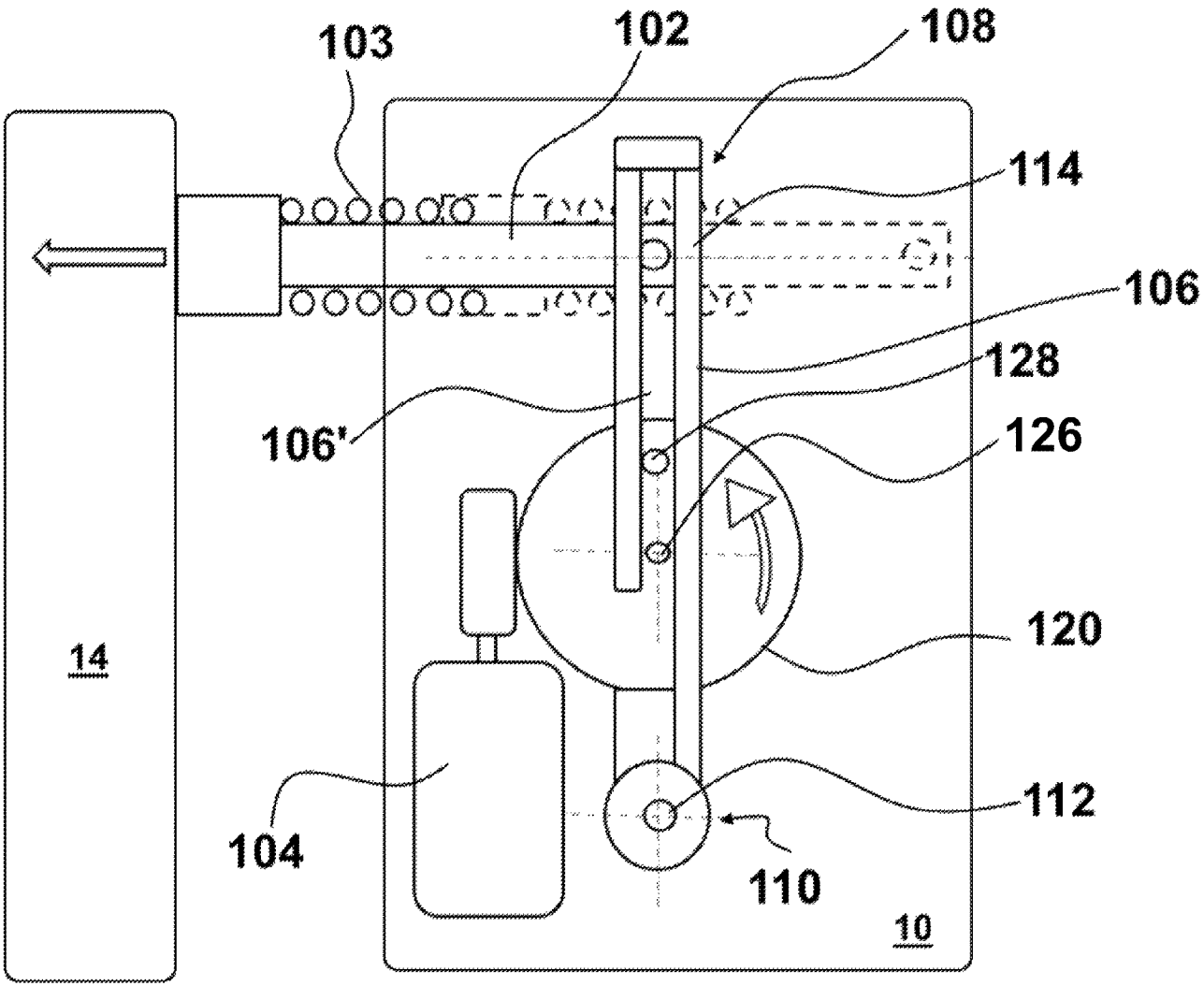
FIG. 5 shows an operation of the powered actuation mechanism of FIG. 4 between a closed position and a partially open position.
Figure 6:
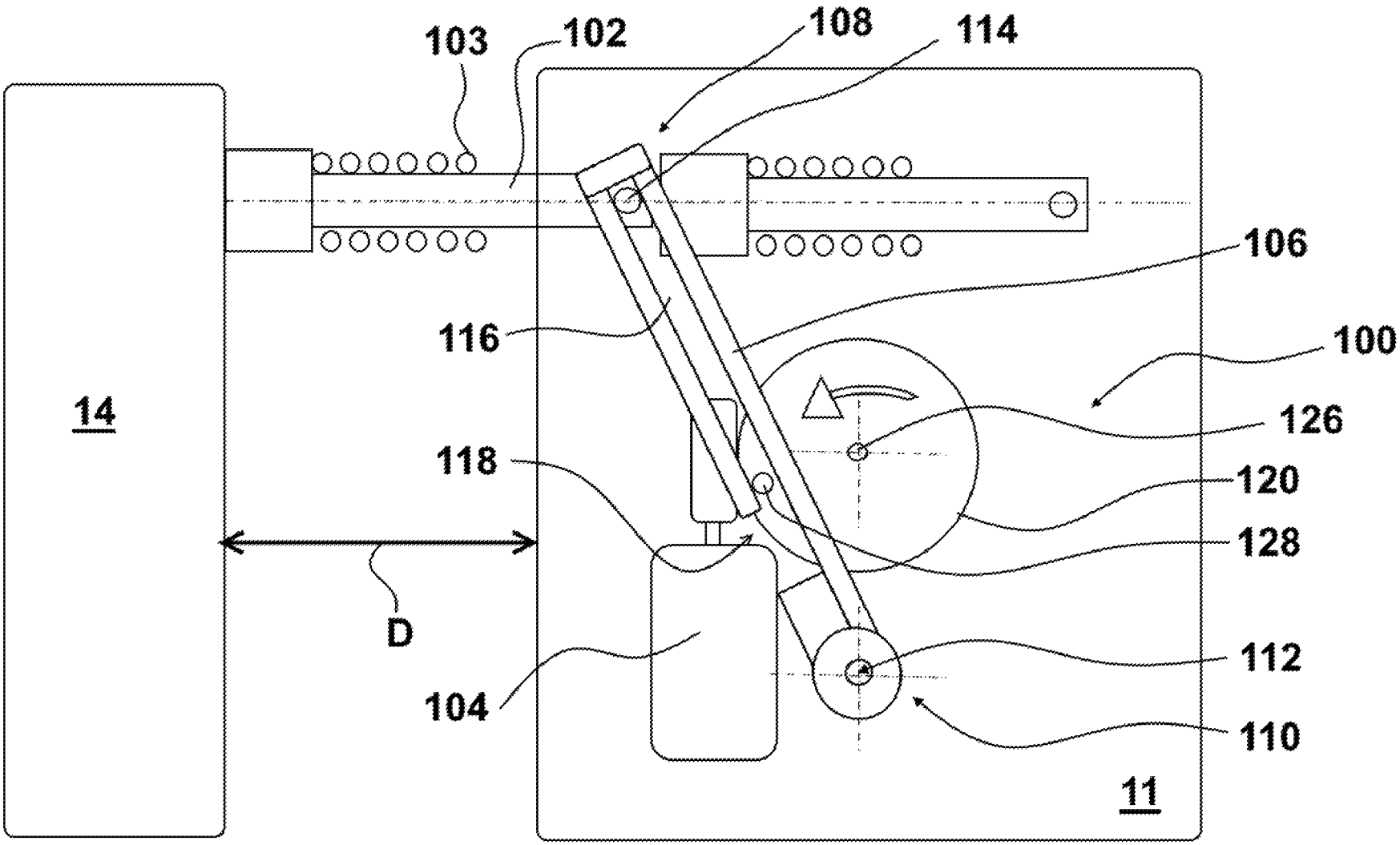
FIG. 6 shows further operation of the powered actuation mechanism of FIG. 4 when reaching the partially open position.

Referring again to FIG. 4, shown is the panel closure device 102 in a closed position of the closure panel 14. In this position, the control connection 128 is engaged and positioned adjacent to the opening 118 of the slot 116. Referring to FIG. 5, as the control member 120 is moved during the first stage of actuation by the motor 104, e.g. rotated about the axis 126, the control connection 128 remains engaged between the lever body 106 and the control member 120 as the control connection 128 travels along the lever body 106 by moving away from the opening 118 and towards the output end 108. Further movement of the control member 120 (e.g. further rotation of the control member 120 about the axis 126) during the first stage of actuation causes the control connection 128 to remain engaged and to travel back along the lever body 106 away from the output end 108 and back towards the opening 118—see FIG. 6. It is recognised that as the control connection 128 travels along the lever body 106 during the first stage of actuation, the pivot end 110 pivots about the first pivot connection 112 and the output end 108 pivots about the second pivot connection 114. Thus, during the first stage of actuation the control connection reciprocates along the lever body 106 by traveling away and then towards the opening 118. Towards the end the first stage of actuation, the closure panel device 102 has positioned the closure panel 14 from the closed position (see FIG. 4) to a partially open position (see FIG. 6), as the closure panel 14 is distanced D from the body 11. It is recognised that FIGS. 5 and 6 show closed position of the panel closure device 102 in ghosted view.

Figure 7:
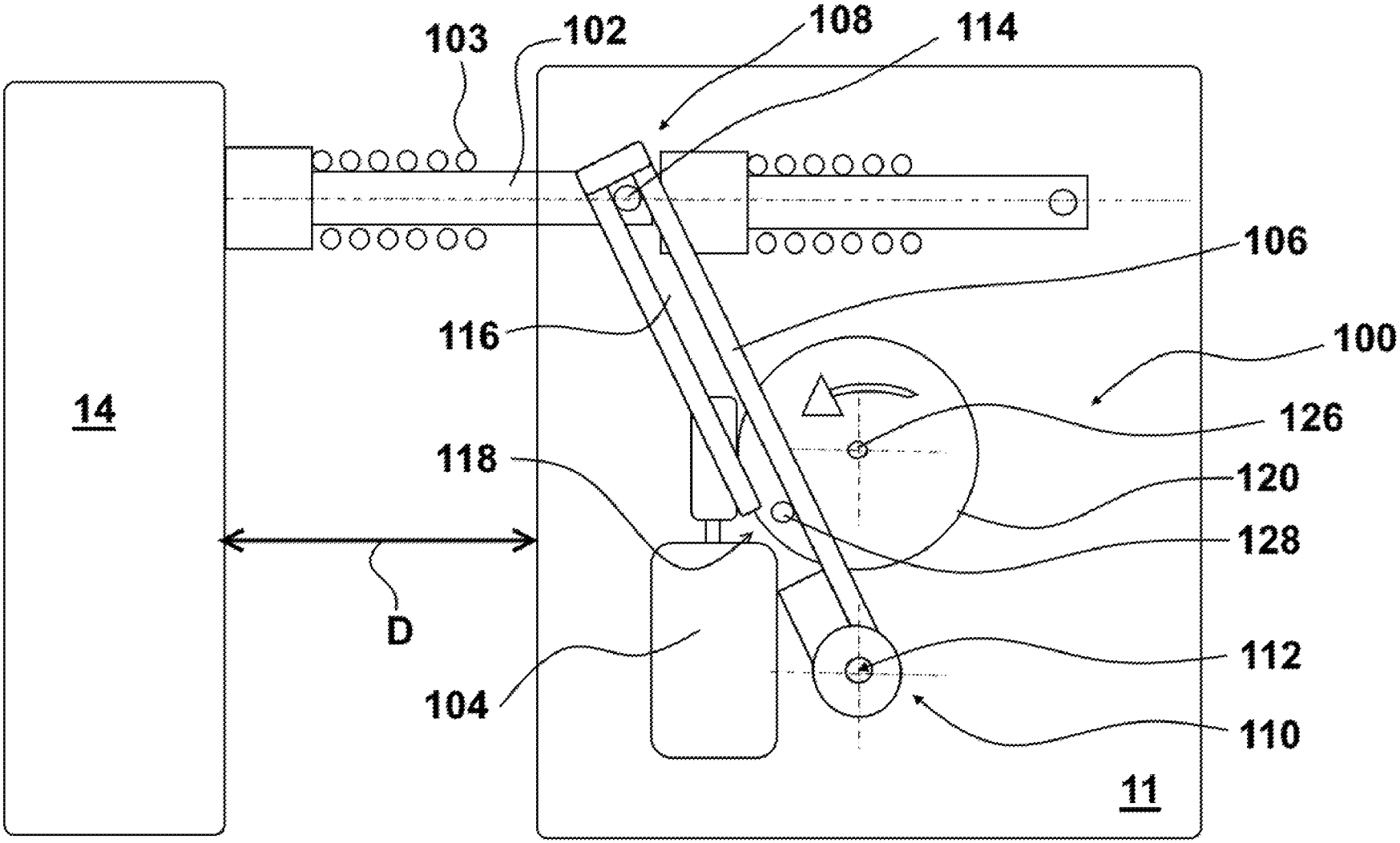
FIG. 7 shows further operation of the powered actuation mechanism of FIG. 6.
Figure 8:
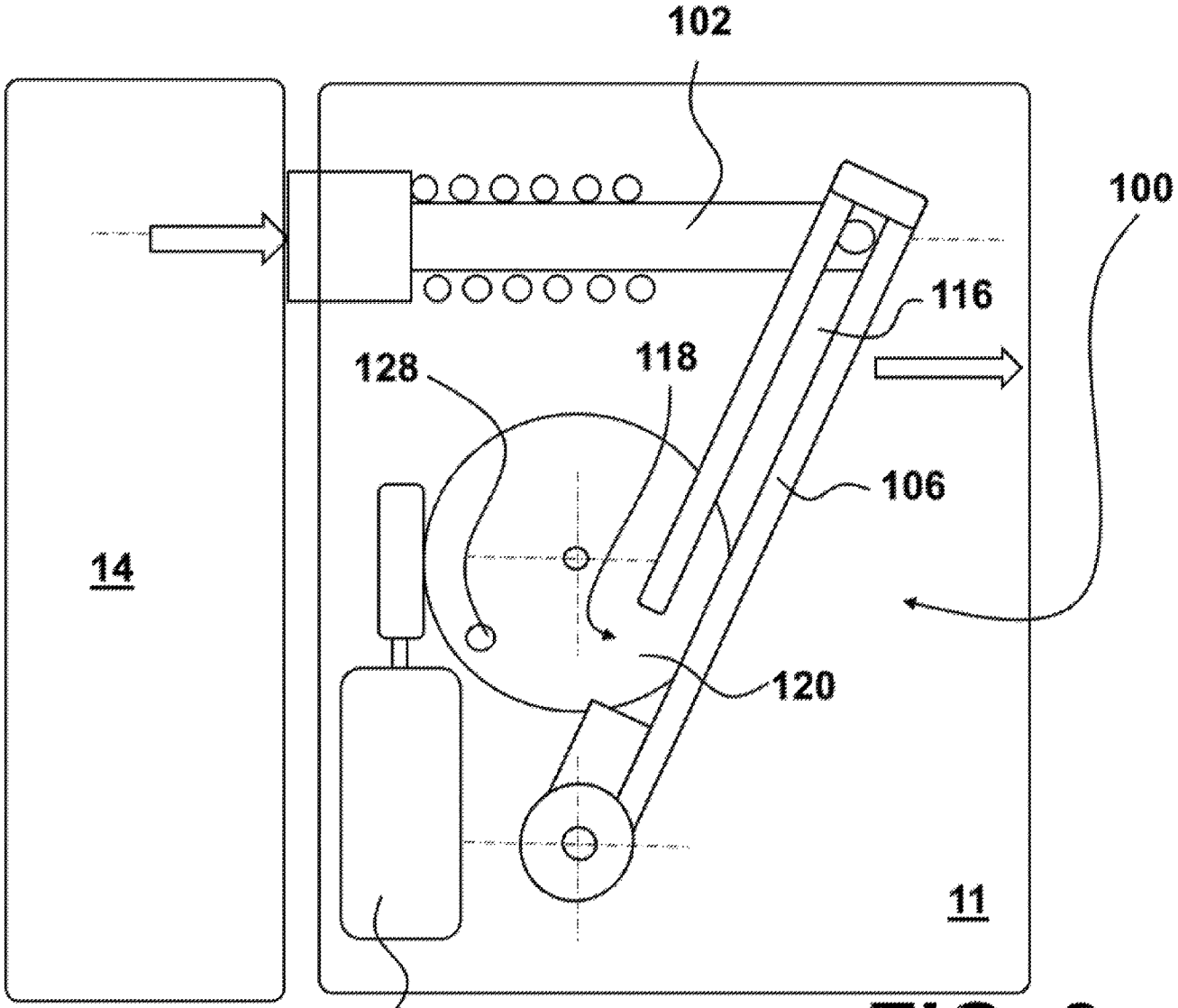
FIG. 8 shows further operation of the closure panel of FIG. 7.

Referring to FIG. 7, shown is the closure panel device 102 moved from the partially open position (see FIG. 6) towards the fully open position (see FIG. 1). This is a result of further movement of the control member 120 during the second stage of actuation to cause the control connection 128 to be positioned in the opening 118, and thus effectively decoupling the control member 120 from the lever body 106 as the pin 128 is now free to move out of the slot 116 upon moving of the closure panel 14 back towards the closed position (e.g. a result of closing the closure panel 14 manually by an occupant of the vehicle 10)—see FIG. 8. It is recognised that comparing the views in FIGS. 7 and 8, the panel closure device 102 is free to move from the partially open position back towards the fully closed position without corresponding movement of the control member 120, as the control connection 128 can be disengaged, thus decoupling the control member 120 from the lever body 106. As recognised in FIG. 8, an advantage of the disengagement of the control connection (after the second stage of actuation) provides for a reopening of the closure panel 14 without having to use the door closure device 102 as it is also uncoupled from the control member 120 and thus motor 104.

Figure 9:
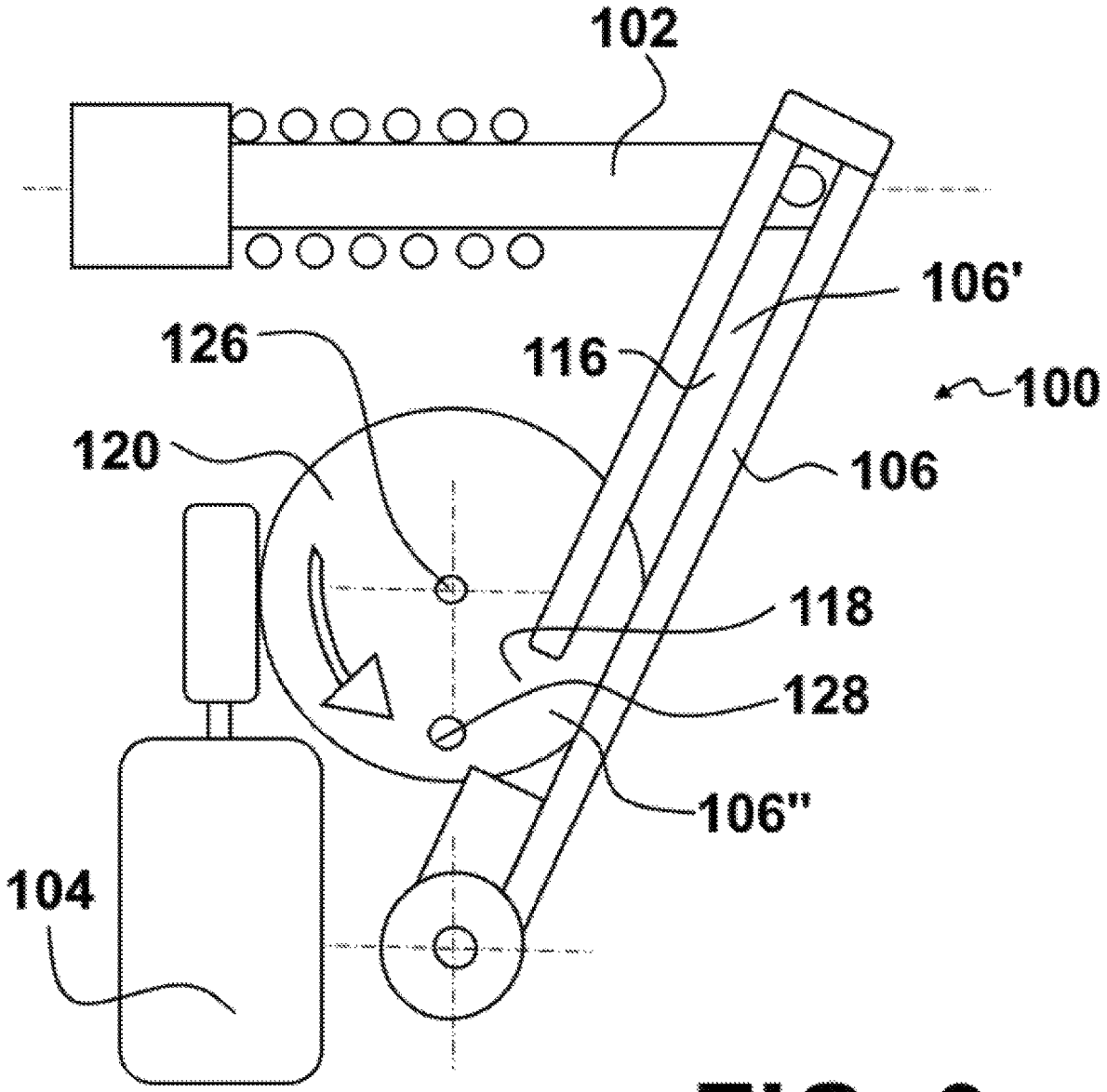
FIG. 9 shows further operation of the powered actuation mechanism of FIG. 8.
Figure 10:
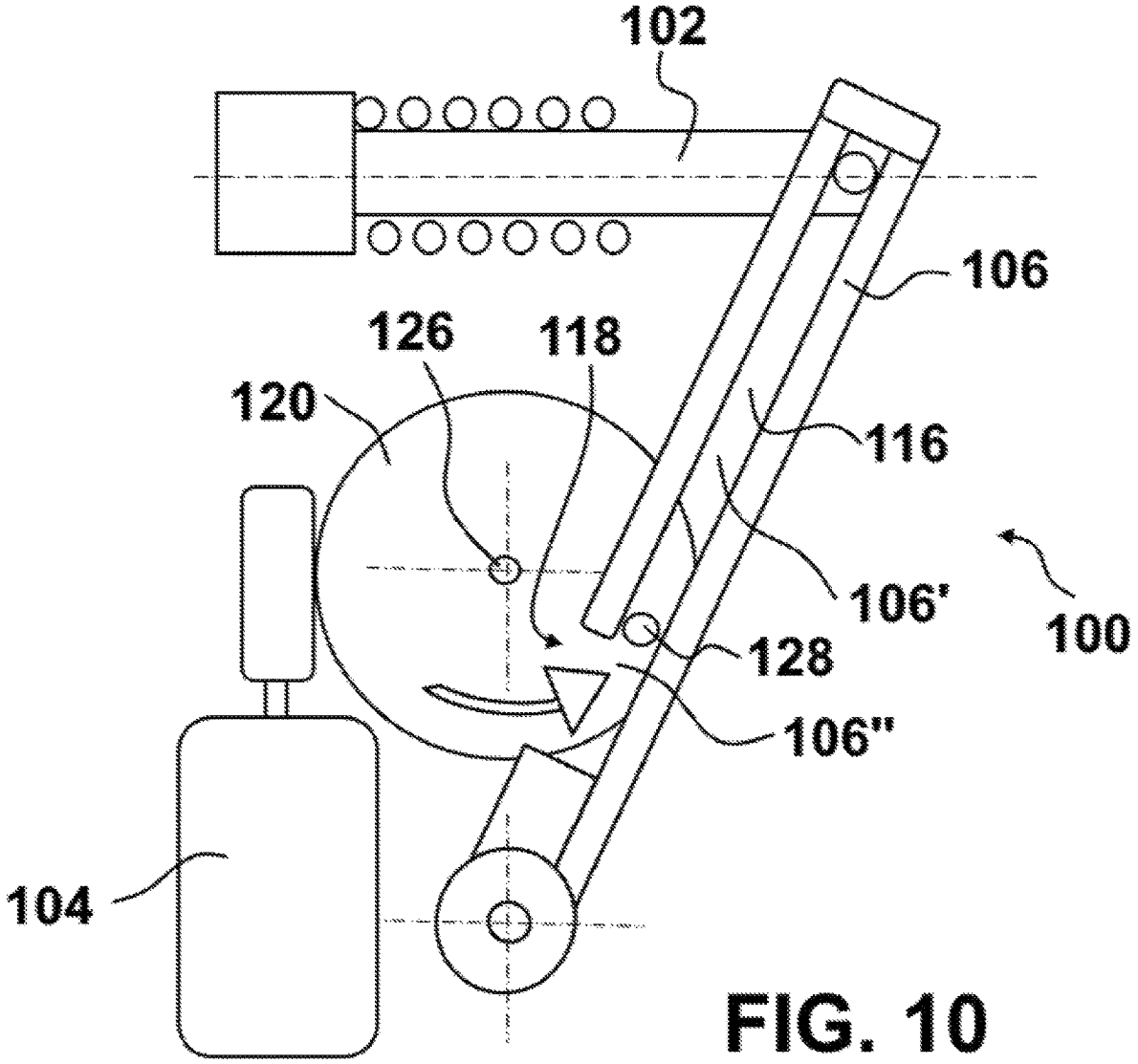
FIG. 10 shows further operation of the powered actuation mechanism of FIG. 9 once reset.

Referring to FIGS. 9 and 10, the control member 120 can be further moved (e.g. rotated about the axis 126) to move the control connection 128 through the opening 118 and into the slot 116 of the lever body 106, thus reengaging the control connection 128 and thus recoupling the lever body 106 with the control member 120—see FIG. 10. Recoupling of the control connection 128 thus resets the powered actuation mechanism 100 to its fully closed position—see FIGS. 4,10. It is recognised that movement of the control member 120 can be done from the partially open back to the fully closed position by operation of the motor 104.

In view of the above, it is recognised that a powered actuation mechanism 100 can be utilized for different individual actuation functions acting on the closure panel device 102, such as a door presenter 90, or the ratchet 92, or the release lever 96, or a lock mechanism as examples. As such, the powered actuation mechanism can be configured as a reciprocating rectilinear motion actuator with the lever body 106 (e.g. arm) having one output end 108 coupling to the closure panel device 102 and other input end (coupled to the control member/disk 120 via a control connection 128 (e.g. gear pin 128 releasably retained in slot 116) for imparting an oscillation to the output end 108 and thus to the control panel device 102 via the second pivot connection 114 (e.g. pin 114 maintained and retained in the slot 116).

As such, the input end (at the control connection 128) has engagement and disengagement features such that over a certain angular rotation of the disk 120 (e.g. first movement path of the control member 120), the disk 120 is coupled to the lever body 106 (e.g. arm), and over another angular rotation the disk 120 (e.g. second movement path of the control member 120) is decoupled from the lever body 106. It is recognised that the first stage of actuation corresponds with the first movement path of the control member 120 and the second stage of actuation corresponds with the second movement path of the control member 120. Also as noted, the control member 120 input via the control connection 128 (when engaged) is positioned between the output end 108 and the first pivot point such that is can be reset quickly since the angular rotation of the disk acts close to the pivot end 110 of the lever body 106. It is also recognised that the control member 120 can also be configured at certain angular orientations to act on other vehicle 10 components in the sequence of operation, such as the release lever 96 before the presentment stage begins. As such, the control member 120 can be coupled via respective control connections 128 to multiple closure panel devices 102 at the same time, i.e. a one control member 120 to many closure panel devices 102 relationship.

Figure 11:
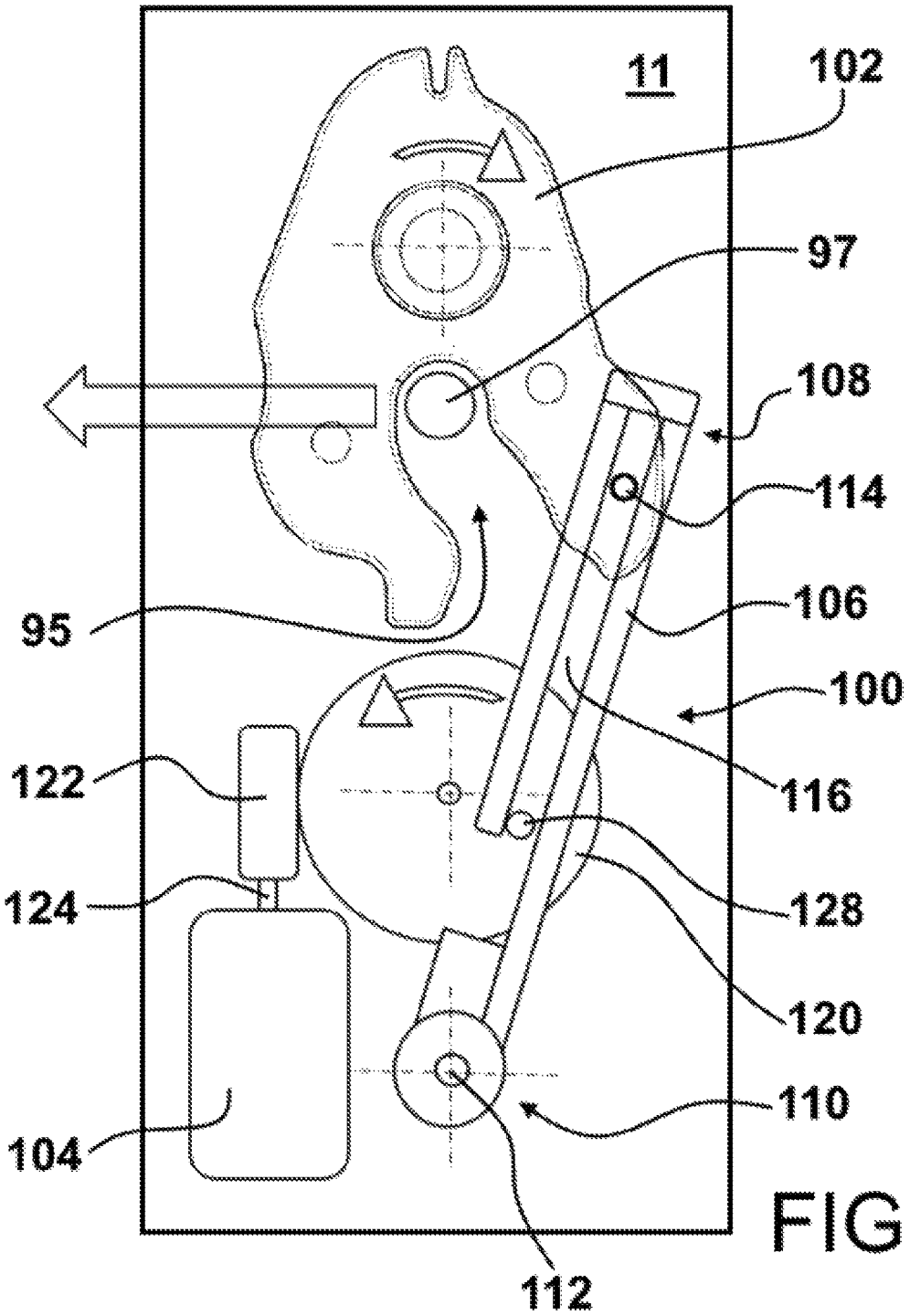
FIG. 11 shows further details of an embodiment of the closure panel device of FIG. 1.

Referring to FIG. 11, a further embodiment of the powered actuation mechanism 100 has the motor 104 mounted on the body 11 of the vehicle 10 (see FIG. 1). The lever body 106 is coupled at one end 108 (e.g. output end) to the closure panel device 102 (e.g. a ratchet of the latch 94—see FIG. 2) and to the pivot end 110 on the body 11. The coupling at the pivot end 110 is by the first pivot connection 112 (e.g. via a pin mounted on the body 11) and at the output end 108 by the second pivot connection 114 (e.g. via a pin mounted on a body 111 of the closure panel device 102). The pins can also be referred to by their respective pivot connection designations, i.e. pin 112 and pin 114 for the sake of simplicity). The closure panel device 102 can be biased towards the open position by a resilient element (e.g. spring—not shown).

The lever body 106 can include the slot 116 extending along the lever body 106 from the output end 108 towards the pivot end 110, such that the pin 114 is retained in the slot 116 during actuation of the closure panel device 102. The slot 116 of the lever body 106 also has the opening 118 positioned adjacent to the slot 116, the opening 118 opposite to the output end 108, such that the opening 118 is positioned between the output end 108 and the pivot end 112 of the lever body 106. The motor 104 is coupled to the lever body 106 via the control member 120 (e.g. a disk having gear teeth 121) for engaging with the gear 122 (e.g. worm gear) connected to the motor 104 by shaft 124. For example, the control member 120 can be mounted on the axis 126 coupled/connected to the body 11. The control member 120 is coupled to the lever body 106 by the control connection 128 (e.g. via a pin mounted on the control member 120 and positioned in the slot 116). The pin can also be referred to by its respective connection designation, i.e. pin 128 for the sake of simplicity). Further, the control member 120 can be decoupled from the lever body 106 by providing for the pin 128 to exit the slot 116 via the opening 118.

Accordingly, the pin 128 is retained in the slot 116 during the first stage of actuation of the closure panel device 102 and is decoupled from the slot 116 during the second stage of actuation of the closure panel device 102. This decoupling of the pin 128 from the slot 116 is provided by the pin 128 exiting the slot 116 via the opening 118, as further described below. The control connection 128 between the lever body 106 and the control member 120 is thus engaged during the first stage of actuation and disengaged during the second stage of actuation.

Figure 12:
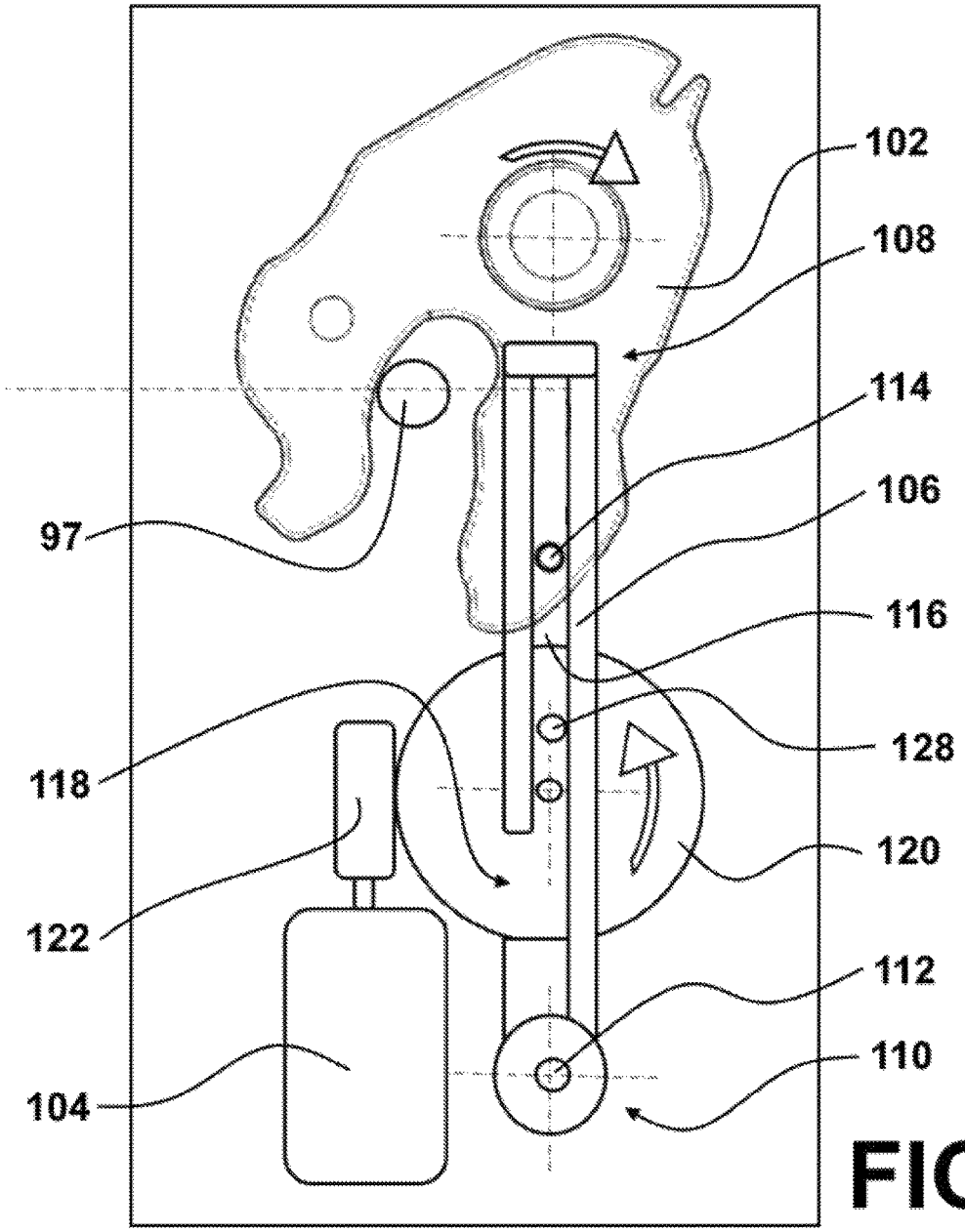
FIG. 12 shows an operation of the powered actuation mechanism of FIG. 11 between a closed position and a partially open position.

Referring again to FIG. 11, shown is the panel closure device 102 in the closed position of the closure panel 14 (e.g. ratchet 90 is engaged in slot 95 with a striker 97 mounted on the closure panel 14—see FIG. 2). In this manner, the closure panel device 102 would pivot about pivot 99 during actuation of the lever body 106 by the control connection 128 when engaged. In this position, the control connection 128 is engaged and positioned adjacent to the opening 118 of the slot 116. Referring to FIG. 12, as the control member 120 is moved during the first stage of actuation by the motor 104, e.g. rotated about the axis 126, the control connection 128 remains engaged between the lever body 106 and the control member 120 as the control connection 128 travels along the lever body 106 by moving away from the opening 118 and towards the output end 108. Further movement of the control member 120 (e.g. further rotation of the control member 120 about the axis 126) during the first stage of actuation causes the control connection 128 to remain engaged and to travel back along the lever body 106 away from the output end 108 and back towards the opening 118—see FIG. 13. It is recognised that as the control connection 128 travels along the lever body 106 during the first stage of actuation, the pivot end 110 pivots about the first pivot connection 112 and the output end 108 pivots about the second pivot connection 114. Thus, during the first stage of actuation the control connection reciprocates along the lever body 106 by traveling away and then towards the opening 118. Towards the end the first stage of actuation, the closure panel device 102 has positioned the closure panel 14 from the closed position (see FIG. 11) to a partially open position (see FIG. 13), as the closure panel 14 is distanced D from the body 11—see FIG. 6 by example.

Figure 14:
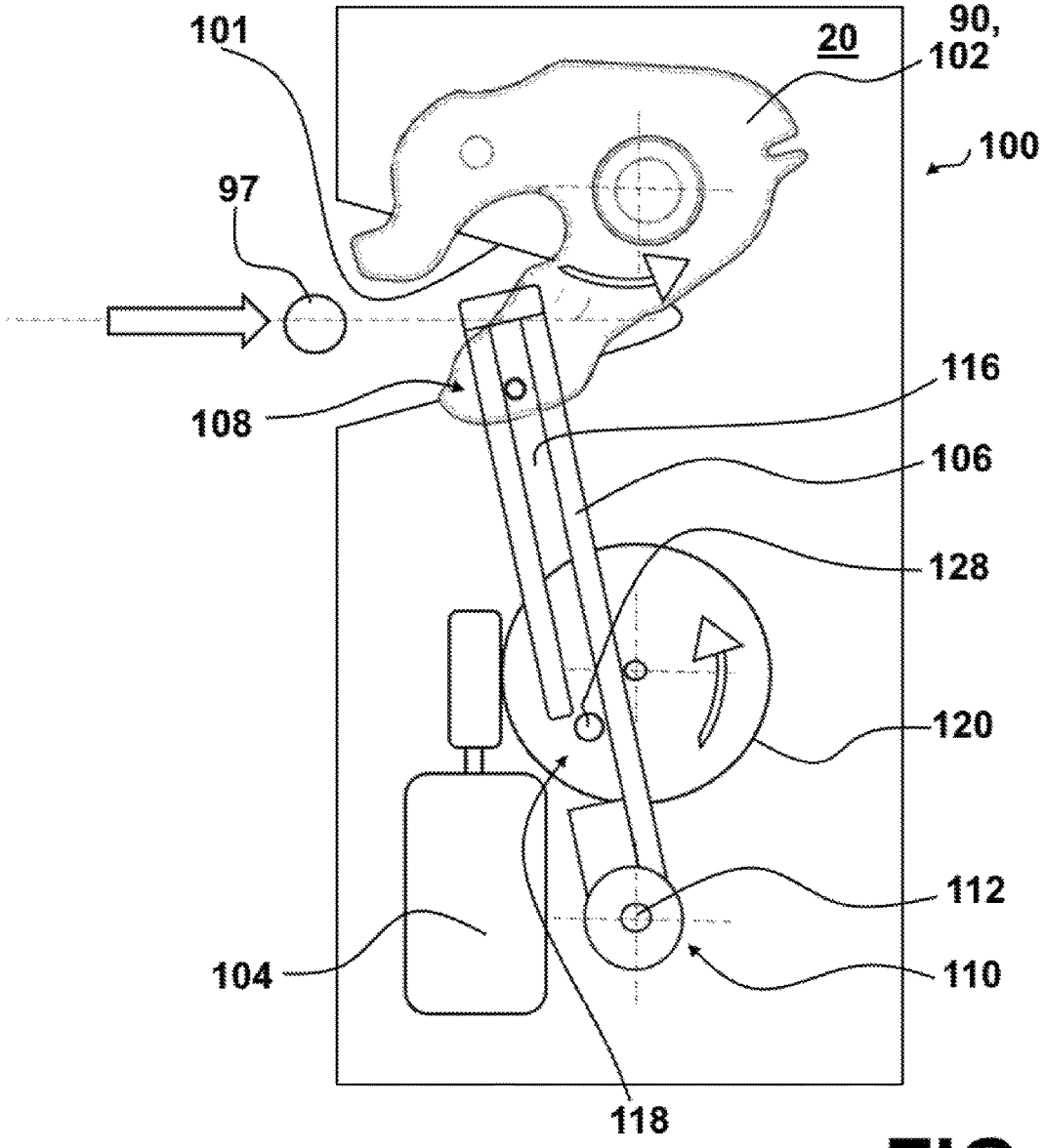
FIG. 14 shows further operation of the powered actuation mechanism of FIG. 13.
Figure 15:
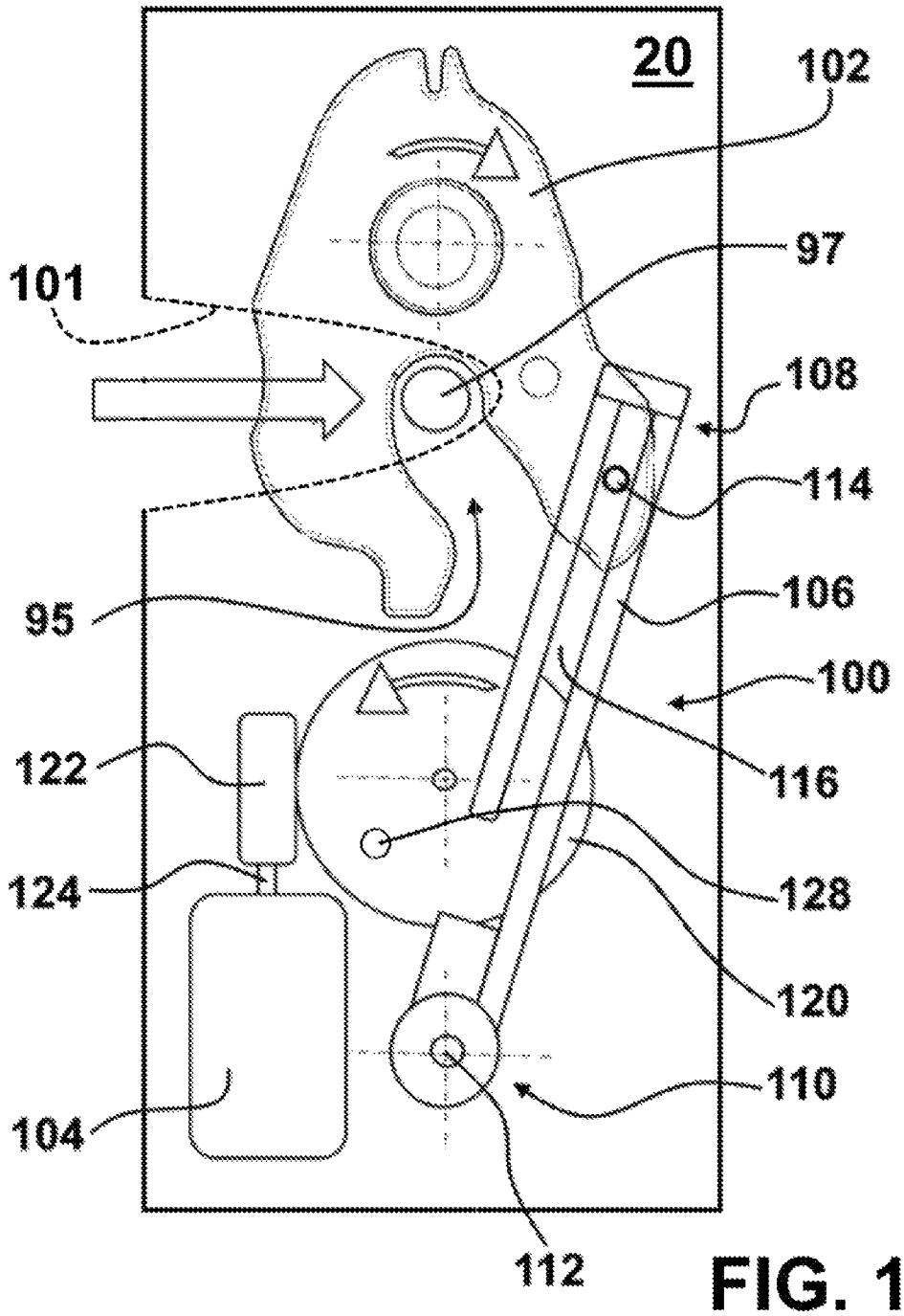
FIG. 15 shows further operation of the closure panel of FIG. 1.

Referring to FIG. 14, shown is the closure panel device 102 moved from the partially open position (see FIG. 13) towards the fully open position (see FIG. 2). This is a result of further movement of the control member 120 during the second stage of actuation to cause the control connection 128 to be positioned in the opening 118, and thus effectively decoupling the control member 120 from the lever body 106 as the pin 128 is now free to move out of the slot 116 upon moving of the closure panel 14 back towards the closed position (e.g. a result of closing the closure panel 14 manually by an occupant of the vehicle 10)—see FIG. 15. It is recognised that comparing the views in FIGS. 14 and 15, the panel closure device 102 is free to move from the partially open position back towards the fully closed position without corresponding movement of the control member 120, as the control connection 128 is disengaged, thus decoupling the control member 120 from the lever body 106. As recognised in FIG. 14, an advantage of the disengagement of the control connection (after the second stage of actuation) provides for a reopening of the closure panel 14 without having to use the door closure device 102 as it is also uncoupled from the control member 120 and thus motor 104.

Figure 16:
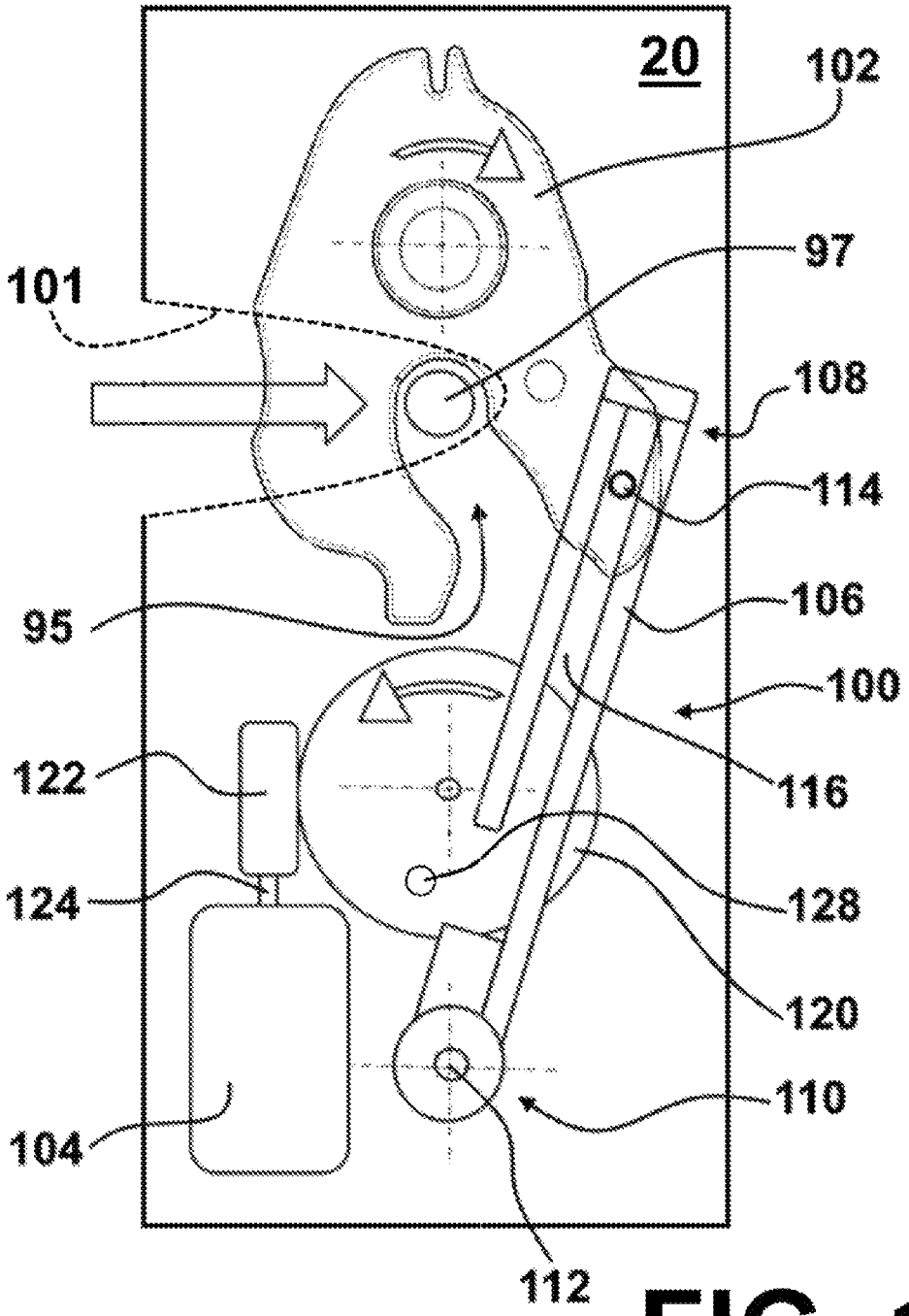
FIGS. 16 and 17 show further operation of the powered actuation mechanism of FIG. 15.
Figure 17:
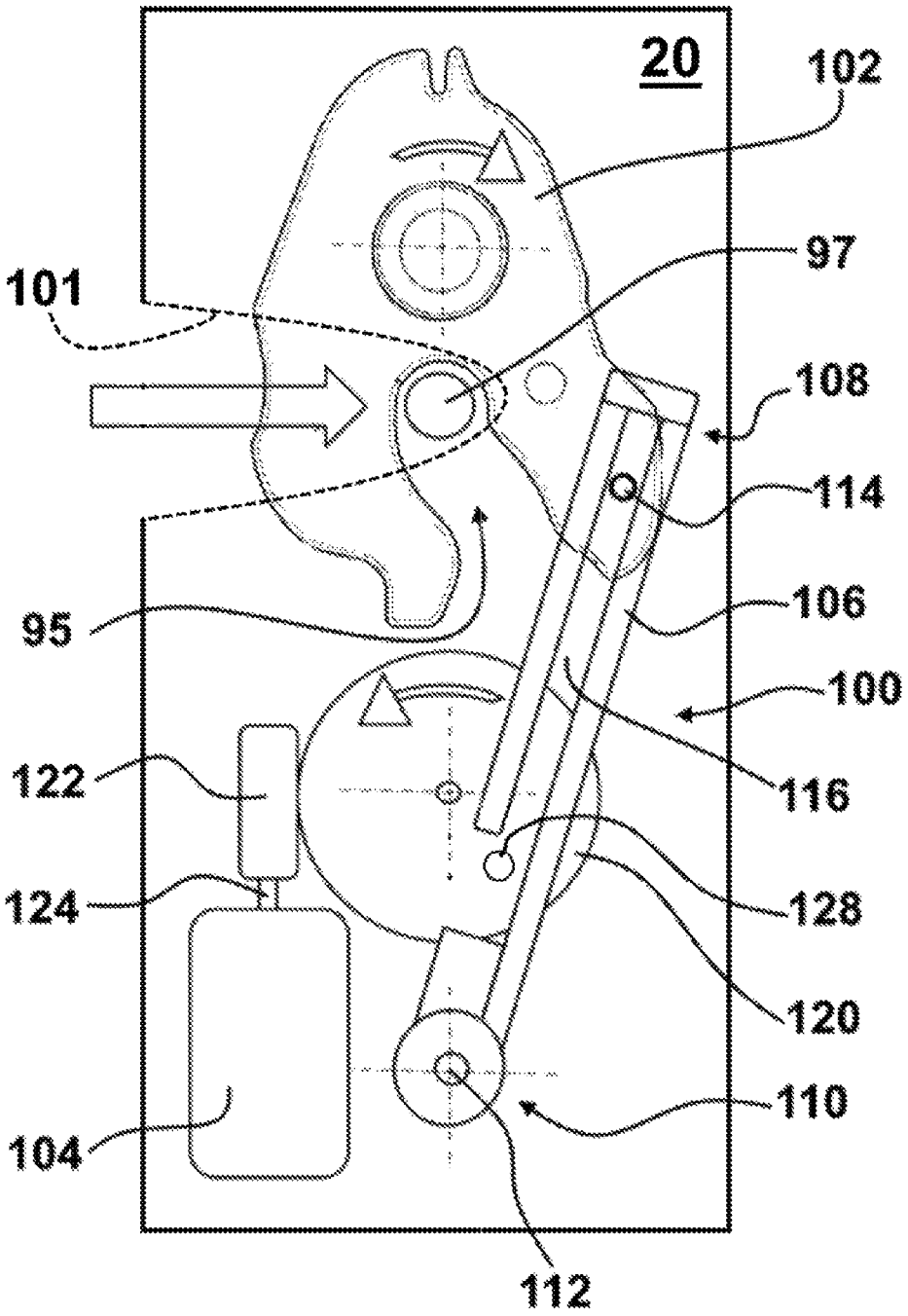
Figure 18:
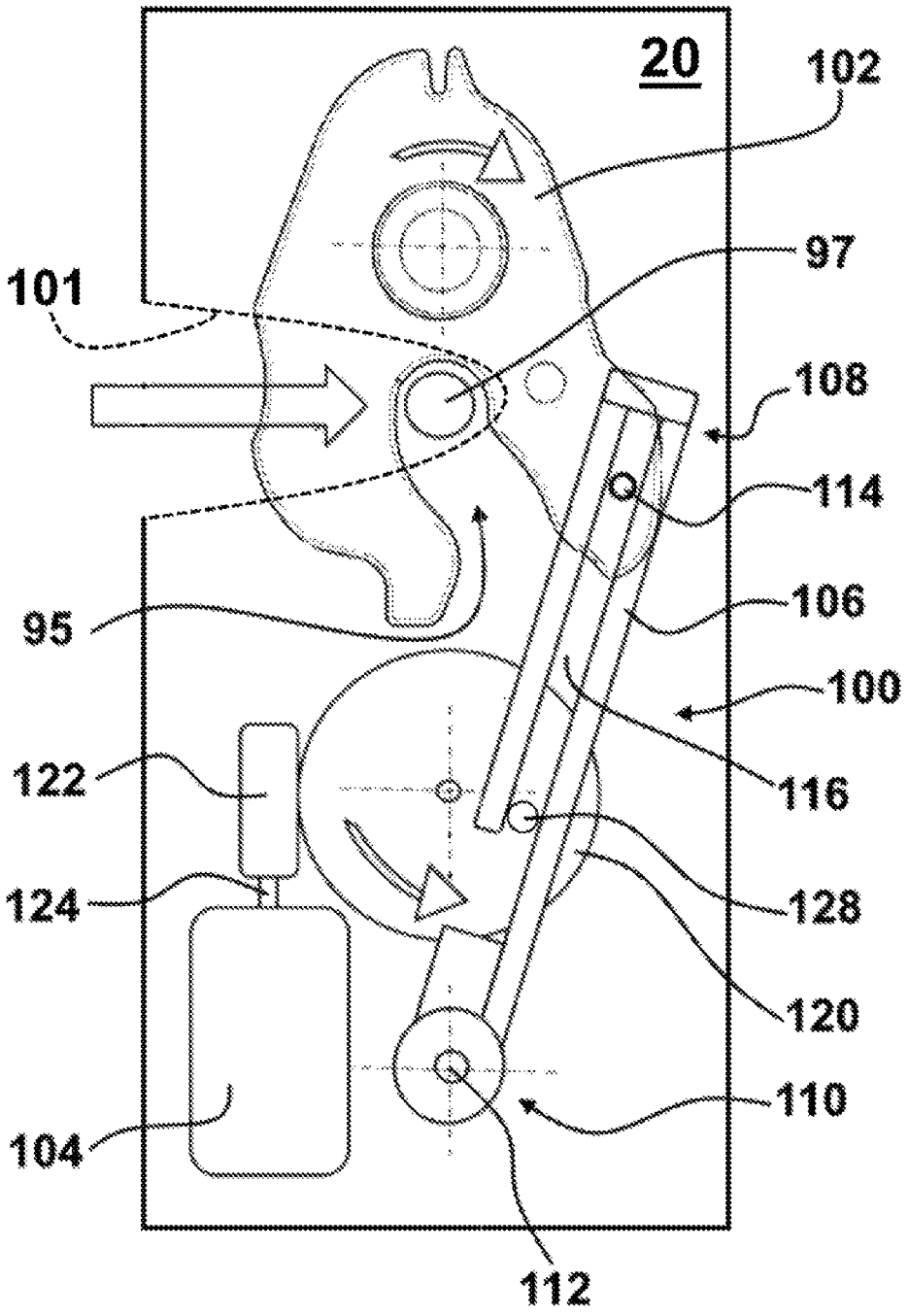
FIG. 18 shows further operation of the powered actuation mechanism of FIG. 17 once reset.

Referring to FIGS. 16,17,18, the control member 120 can be further moved (e.g. rotated about the axis 126) to move the control connection 128 through the opening 118 and into the slot 116 of the lever body 106, thus reengaging the control connection 128 and thus recoupling the lever body 106 with the control member 120—see FIG. 18. Recoupling of the control connection 128 thus resets the powered actuation mechanism 100 to its fully closed position—see FIGS. 11, 18. It is recognised that movement of the control member 120 can be done from the partially open back to the fully closed position by operation of the motor 104.

Referring to FIGS. 8, 15, 16, and 17, in a further embodiment, the powered actuation mechanism 100 is implemented, such that operation of the motor 104 causes movement of the control member 120 over a third range of motion (e.g. a third stage of actuation) between the first and second ranges of motion in order to decouple from the input end 110 for allowing the closure panel device 102 to operate independently of the control member 120. In other words, operating the motor 104 during the first stage of actuation includes engaging the control connection 128 with the (e.g. pivotal) lever body 106 along a first portion 106' of the lever body 106, see FIGS. 4 and 5, such that operating the motor 104 during the second stage of actuation includes engaging (e.g. reengaging) the control connection 128 with the lever body 106 along a second portion 106" of the lever body, see FIGS. 9 and 10, the second portion 106" provided between a pivotal connection 112 of the lever body 104 and the first portion 106'. As such, the third stage of actuation can be regarded as when the closure panel device 102 is operated independently of the control member 120.

Figure 19:
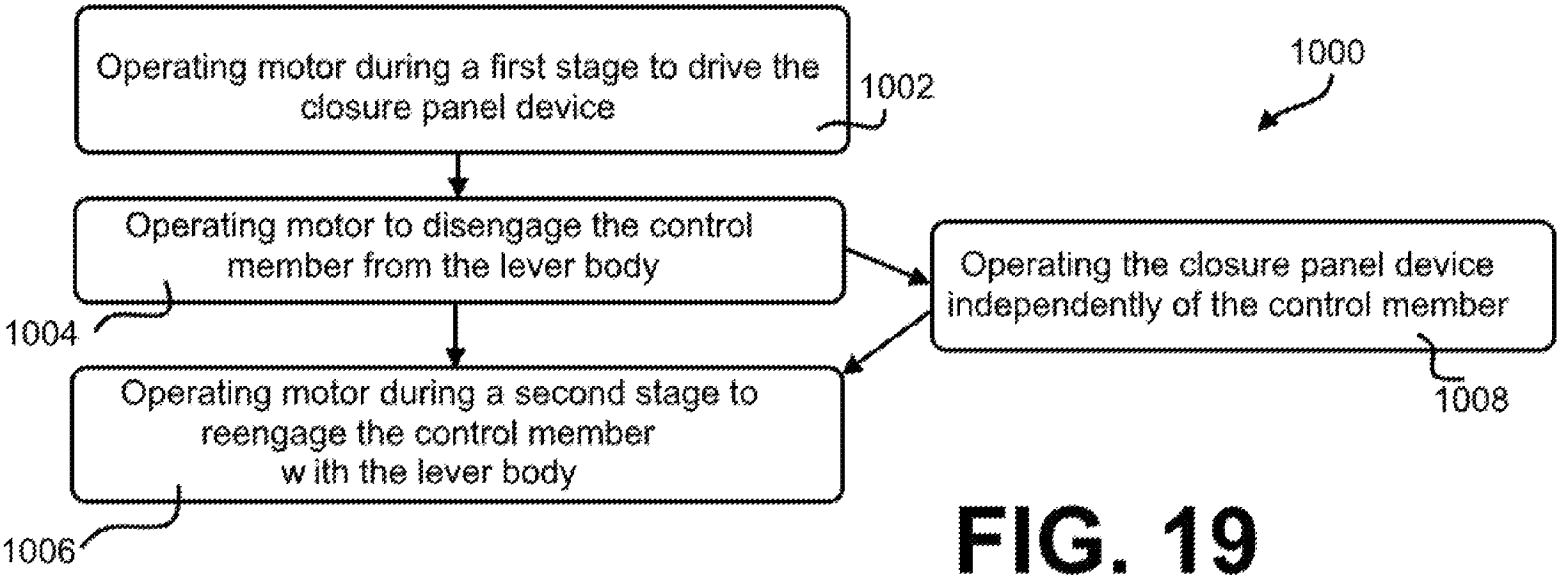
FIG. 19 is a flowchart of an example operation of the powered actuation mechanism of FIG. 1 for example closure panel devices.

Referring to FIGS. 4 and 19, provided is a method 1000, in one embodiment, for operating the powered actuation mechanism 100 coupled to the closure panel device 102 connected to the closure panel 14 of the vehicle 14. The closure panel 14 is operated between the closed position and a partially open position. The method includes a steps of operating 1002 the motor 104 during a first stage of actuation, the motor 104 operatively coupled to the control member 120 in order to move the control member 120 in order to displace the control connection 128 engaged between the control member 120 and the lever body 106 along the lever body 106 between an opening 118 and an output end 108 of the lever body 106 in order to drive the closure panel device 102 coupled to the output end 108, such that the control connection 128 is engaged between the lever body 106 and the control member 120 when the control connection 128 is positioned between the opening 118 and the output end 108. A next step 1004 is operating the motor 104 for moving the control member 120 to disengage the control connection 128 between the control member 120 and the lever body 106 by providing for exit (see FIGS. 7 and 8 by example) of the control connection 128 from the opening 118 in the lever body 106. A further step 1006 is operating the motor 104 during a second stage of actuation in order to reengage the control connection 128 between the control member 120 and the lever body 106 by reinserting the control connection 128 into the opening 118, such that the closure panel device 102 can be operated 1008 independently of the control member 120 during the disengagement between the control member 120 and the lever body 106.

Those in the art will understand that a number of variations may be made in the disclosed embodiments, all without departing from the scope of the invention, which is defined solely by the appended claims.

I claim:

1. A powered actuation mechanism (100) for operating a closure panel device (102) coupled to one of a closure panel (14) and a vehicle body (11) of a vehicle (10), the closure panel operated between a closed position and a partially open position, the mechanism including:

a motor (104) operatively coupled to a control member (120); and a lever body (106) comprising an input end (110) and an output end (108), the output end coupled to the closure panel device for driving the closure panel device in response to driving of the input end by the control member, the input end coupled to either the closure panel or the vehicle body;

wherein operation of the motor causes movement of the control member over a first range of motion in order to couple with the input end for driving the closure panel device in a first direction, and over a second range of motion in order to couple with the input end for driving the closure panel device in a second direction opposite the first direction;

wherein during operation of the motor, movement of the lever body imparts conjoint movement with the closure panel device.

2. The powered actuation mechanism of claim 1, wherein operation of the motor causes movement of the control member over a third range of motion between the first and second ranges of motion in order to decouple from the input end for allowing the closure panel device to operate independently of the control member.

3. The power actuation mechanism of claim 1, wherein the control member is a control disk comprising a pin configured to engage and disengage the lever body when rotated.

4. The power actuation mechanism of claim 1, wherein the lever body comprises a pivot connection (112) about its input end, the control member configured to couple to the lever body between the output end and the pivot connection.

5. The mechanism of claim 4, wherein the pivot connection is mounted on the body of the vehicle, the body hinged to the closure panel.

6. The mechanism of claim 4, wherein the pivot connection is mounted on the closure panel.

7. The mechanism of claim 4, wherein the pivot connection is mounted on a latch back plate (19), the latch back plate coupled to the closure panel.

8. The power actuation mechanism of claim 1 further comprising the lever body mounted at a first end as a pivot end by a first pivot connection (112) and coupled at the output end by a second pivot connection (114), the lever body for driving the closure panel device; and the control member having a control connection (128) coupling the control member to the lever body, the control connection moveable between the first pivot connection and the second pivot connection such that the lever body has an opening (118) to provide a releasable engagement of the control connection between the lever body and the control member.

9. The mechanism of claim 8, wherein the lever body has a slot (116) positioned between the opening and the output end, such that the control connection is coupled to the slot when engaged.

10. The mechanism of claim 9, wherein the control connection is a pin (128) positioned in the slot during said engaged.

11. The mechanism of claim 1, wherein the control member is a disk coupled to the motor via a set of gears (121, 122).

12. A powered actuation mechanism for operating a closure panel device coupled to one of a closure panel and a vehicle body of a vehicle, the closure panel operated between a closed position and a partially open position, the mechanism including:

a motor operatively coupled to a control member; and a lever body comprising an input end and an output end, the output end coupled to the closure panel device for driving the closure panel device in response to driving of the input end by the control member, the input end coupled to either the closure panel or the vehicle body;

wherein operation of the motor causes movement of the control member over a first range of motion in order to couple with the input end for driving the closure panel device in a first direction, and over a second range of motion in order to couple with the input end for driving the closure panel device in a second direction opposite the first direction;

wherein the closure panel device is a door presenter (90) used during said driving for moving the closure panel between the closed position and the partially open position.

13. A method for operating a powered actuation mechanism coupled to a closure panel device connected to one of a closure panel and a vehicle body of a vehicle, the closure panel operated between a closed position and a partially open position, the method including:

operating a motor during a first stage of actuation, the motor operatively coupled to a control member having a control connection engaged with a pivotal lever body coupled to the closure panel device, in order to move the control connection to pivotally drive the lever body to drive the closure panel device in a first direction; and operating the motor during a second stage of actuation in order to move the control connection to pivotally drive the lever body to drive the closure panel device in a second direction opposite the first direction;

wherein during operation of the motor, movement of the lever body imparts conjoint movement with the closure panel device.

14. The method of claim 13, wherein the step of operating the motor during the first stage of actuation includes engaging the control connection with the pivotal lever body along a first portion (106') of the lever body, wherein the step of operating the motor during the second stage of actuation includes engaging the control connection with the pivotal lever body along a second portion (106") of the lever body, wherein the second portion is provided between a pivotal connection of the lever body and the first portion.

15. The method of claim 13 further comprising operating the motor during the first stage of operation by moving the control member to disengage the control connection between the control member and the lever body by providing for exit of the control connection from an opening in the lever body, and operating the motor during the second stage of actuation in order to reengage the control connection between the control member and the lever body, such that the closure panel device is operated independently of the control member during said disengage.

16. The method of claim 13 further comprising operating the motor causes movement of the control member over a third stage of actuation between the first stage of actuation and the second stage of actuation in order to decouple from an input end for facilitating the closure panel device to operate independently of the control member.

17. The method of claim 13, wherein the control member is a control disk comprising a pin configured to engage and disengage the lever body when rotated.

18. The method of claim 13, wherein the lever body comprises an input end and an output end, the output end coupled to the closure panel device for driving the closure panel device in response to driving of the input end by the control member, the input end coupled to either the closure panel or the vehicle body.

* * * * *